US008703680B2

(12) United States Patent
Suen

(10) Patent No.: US 8,703,680 B2
(45) Date of Patent: Apr. 22, 2014

(54) LUBRICATING COMPOSITION CONTAINING FRICTION MODIFIER BLEND

(75) Inventor: Yat Fan Suen, Pinole, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 16 days.

(21) Appl. No.: 13/293,382

(22) Filed: Nov. 10, 2011

(65) Prior Publication Data

US 2012/0129743 A1 May 24, 2012

Related U.S. Application Data

(60) Provisional application No. 61/417,051, filed on Nov. 24, 2010.

(51) Int. Cl.
*C10M 169/04* (2006.01)
*C10M 163/00* (2006.01)

(52) U.S. Cl.
USPC ..... 508/503; 508/185; 508/198

(58) Field of Classification Search
CPC ..... C10M 2227/061; C10M 2207/289
USPC ..... 508/198, 503, 185
See application file for complete search history.

(56) References Cited

U.S. PATENT DOCUMENTS

| | | | | |
|---|---|---|---|---|
| 3,036,003 | A | 5/1962 | Verdol, III | |
| 3,172,892 | A | 3/1965 | LeSuer et al. | |
| 3,219,666 | A | 11/1965 | Norman et al. | |
| 3,272,746 | A | 9/1966 | LeSuer et al. | |
| 3,275,554 | A | 9/1966 | Wagenaar | |
| 3,329,658 | A | 7/1967 | Fields | |
| 3,438,757 | A | 4/1969 | Honnen et al. | |
| 3,449,250 | A | 6/1969 | Fields | |
| 3,454,555 | A | 7/1969 | van der Voort et al. | |
| 3,565,804 | A | 2/1971 | Honnen et al. | |
| 3,586,629 | A | 6/1971 | Otto et al. | |
| 3,591,598 | A | 7/1971 | Traise et al. | |
| 3,631,218 | A * | 12/1971 | Carter et al. | 585/665 |
| 3,666,730 | A | 5/1972 | Coleman | |
| 3,933,659 | A | 1/1976 | Lyle et al. | |
| 3,980,569 | A | 9/1976 | Pindar et al. | |
| 4,089,791 | A * | 5/1978 | Haugen et al. | 508/373 |
| 4,234,435 | A | 11/1980 | Meinhardt et al. | |
| 4,259,194 | A | 3/1981 | deVries et al. | |
| 4,259,195 | A | 3/1981 | King et al. | |
| 4,261,843 | A | 4/1981 | King et al. | |
| 4,263,152 | A | 4/1981 | King et al. | |
| 4,265,773 | A | 5/1981 | deVries et al. | |
| 4,283,295 | A | 8/1981 | deVries et al. | |
| 4,285,822 | A | 8/1981 | deVries et al. | |
| 4,369,119 | A | 1/1983 | deVries et al. | |
| 4,370,246 | A | 1/1983 | deVries et al. | |
| 4,394,279 | A | 7/1983 | deVries et al. | |
| 4,402,840 | A | 9/1983 | deVries et al. | |
| 4,474,671 | A | 10/1984 | Herd et al. | |
| 4,492,642 | A | 1/1985 | Horodysky | |
| 4,612,132 | A | 9/1986 | Wollenberg et al. | |
| 4,622,158 | A | 11/1986 | Walsh | |
| 4,683,069 | A | 7/1987 | Brewster et al. | |
| 4,746,446 | A | 5/1988 | Wollenberg et al. | |
| 4,892,670 | A | 1/1990 | Mendelson | |
| 4,957,651 | A | 9/1990 | Schwind | |
| 5,021,173 | A | 6/1991 | Waddoups et al. | |
| 5,114,603 | A | 5/1992 | Kennedy et al. | |
| 5,286,394 | A | 2/1994 | Moore | |
| 5,540,851 | A | 7/1996 | Lange | |
| 5,629,272 | A | 5/1997 | Nakazato et al. | |
| 5,716,912 | A | 2/1998 | Harrison et al. | |
| 5,866,520 | A | 2/1999 | Addagarla et al. | |
| 5,885,942 | A | 3/1999 | Zhang et al. | |
| 6,153,565 | A | 11/2000 | Skinner et al. | |
| 6,165,235 | A | 12/2000 | Kolp et al. | |
| 6,281,179 | B1 | 8/2001 | Skinner et al. | |
| 6,372,696 | B1 | 4/2002 | Tipton | |
| 6,429,178 | B1 | 8/2002 | Skinner et al. | |
| 6,429,179 | B1 | 8/2002 | Skinner et al. | |
| 6,440,905 | B1 | 8/2002 | Epps et al. | |
| 6,962,896 | B2 | 11/2005 | Ruhe, Jr. et al. | |
| 7,615,521 | B2 | 11/2009 | Eveland et al. | |
| 2005/0209111 | A1 | 9/2005 | Ruhe, Jr. et al. | |
| 2005/0250655 | A1 * | 11/2005 | Adams et al. | 508/287 |

FOREIGN PATENT DOCUMENTS

| | | | |
|---|---|---|---|
| EP | 335701 | A | 10/1989 |
| EP | 0747464 | A | 12/1996 |
| EP | 0799883 | A | 10/1997 |
| EP | 1367116 | A | 12/2003 |
| EP | 1757673 | A1 | 2/2007 |
| WO | 93/21288 | A1 | 10/1993 |

OTHER PUBLICATIONS

PCT International Search Report, International Appl. No. PCT/US2011/060199, dated Jun. 29, 2012.

Supplementary European Search Report, Application No./Patent No. 11842713.7-1352/2643440 PCT/US2011/060199, Sep. 13, 2013, 2 pages.

* cited by examiner

*Primary Examiner* — Cephia D. Toomer
*Assistant Examiner* — Vishal Vasisth
(74) *Attorney, Agent, or Firm* — Joseph P. Foley

(57) ABSTRACT

Disclosed are friction modifier compositions and a method of lubricating an internal combustion engine, comprising supplying to said engine an oil of lubricating viscosity and from 0.25 to 5 weight percent based upon the total mass of the lubricating oil composition of a friction modifier composition containing:

a) an amino alcohol reaction product prepared by isomerizing a $C_{12}$-$C_{30}$ normal alpha olefin using at least one of a solid or liquid catalyst to form an internal olefin; epoxidizing said olefin; and reacting with a mono-hydroxyl amine;

b) an ester of glycerol and a $C_{12}$-$C_{22}$ carboxylic acid containing 0 to 3 double bonds.

13 Claims, No Drawings

LUBRICATING COMPOSITION CONTAINING FRICTION MODIFIER BLEND

FIELD OF INVENTION

Lubricating oil compositions commonly employ friction modifier compounds to improve frictional properties of the composition, potentially improving fuel economy for internal combustion engine.

BACKGROUND

While motor vehicle manufacturers continue to seek improved fuel economy through engine design; new approaches in formulating engine oils have played an important role in improving fuel economy and have resulted in improved emission characteristics of motor vehicles. Lubricant optimization is especially preferred over engine hardware changes, due to its comparative lower cost per unit in fuel efficiency and possibility for backward compatibility with older engines. Therefore, formulators are under continued pressure to develop engine oils and additive packages which take advantage of new performance basestocks and additive blends which demonstrate better fuel efficiency, oxidative stability, volatility, and improved viscosity index (to name a few characteristics) over conventional formulations. To improve fuel efficiency, there has been a drive to use lower viscosity engine oils, which often requires new additive package formulations. High on the list of requirements for these new formulated engine oil specifications are those employing components which improve the frictional properties of the lubricating oil composition. In this case, the additive system design is the crucial factor and close attention must be focused on the additive/additive and additive/base fluid interactions.

Engine oil acts as a lubricant between moving engine parts at various conditions of load, speed and temperature. Hence, the various engine components experience different combinations of boundary layer, mixed and (elasto) hydrodynamic regimes of lubrication; with the largest frictional losses at piston liner/piston ring interface and a smaller part by the bearing and valve train. To reduce the energy losses due to friction of the various parts and to prevent engine wear, additives are incorporated into the engine oil such as friction modifiers, anti-wear agents, and antioxidants; the latter of which tend to lengthen the effect of the afore mentioned additives. Also to reduce the hydrodynamic friction in the piston/cylinder, the viscosity of engine oils has been lowered which has increased the dependence of friction modifiers to offset the new boundary layer regime. Hence, a vast amount of effort has focused on the interaction of oil viscosity with various friction modifiers to improve fuel economy.

Friction modifiers have been around for several years for application in limited slip gear oils, automatic transmission fluids, slideway lubricants and multipurpose tractor fluids. With the desire for increased fuel economy, friction modifiers have been added to automotive crankcase lubricants and several are known in the art. They generally operate at boundary layer conditions at temperatures where anti-wear and extreme pressure additives are not yet reactive by forming a thin mono-molecular layers of physically adsorbed polar oil-soluble products or reaction layers which exhibit a significantly lower friction compared to typical anti-wear or extreme pressure agents. However, under more severe conditions and in mixed lubrication regime these friction modifiers are added with an anti-wear or extreme pressure agent. The most common type is a zinc dithiophosphate (ZnDTP or ZDDP), which, due to emissions considerations, has been reduced in concentration in many current formulations.

Organo-molybdenum compounds are among the most common metal-containing friction modifiers. Typical organo-molybdenum compounds include molybdenum dithiocarbamates (MoDTC), molybdenum dithiophosphates (MoDTP), molybdenum amines, molybdenum alcoholates, and molybdenum alcohol-amides. WO-A-98/26030, WO-A-99/31113, WO-A-99/47629 and WO-A-99/66013 describe tri-nuclear molybdenum compounds for use in lubricating oil compositions. However, the trend towards low-ash lubricating oil compositions has resulted in an increased drive to achieve low friction and improved fuel economy using ashless (organic) friction modifiers.

Ashless (organic) friction modifiers typically comprise esters of fatty acids and polyhydric alcohols, fatty acid amides, amines derived from fatty acids and organic dithiocarbamate or dithiophosphate compounds. Further improvements in lubricant performance characteristics have been achieved through the use of synergistic behaviours of particular combinations of lubricant additives. While numerous combinations of friction modifiers have been made there remains a need to find improvements and synergies between friction modifiers to improve frictional losses and to potentially improve fuel economy and provide cost benefits.

EP-A-1367116, EP-A-0799883, EP-A-0747464, U.S. Pat. No. 3,933,659 and EP-A-335701 disclose lubricating oil compositions comprising various combinations of ashless friction modifiers. Glycerol monooleate (GMO) is well known to function as a friction modifier in lubricant compositions for engines. See, e.g., U.S. Pat. Nos. 5,885,942; 5,866,520; 5,114,603; 4,957,651; and 4,683,069. For example, U.S. Pat. Nos. 5,114,603 and 4,683,069 describe lubricating oil compositions comprising mixtures of glycerol monooleate and glycerol dioleate in combination with other additives which were added for their conventional purpose.

U.S. Pat. No. 5,286,394 discloses a friction-reducing lubricating oil composition and a method for reducing the fuel consumption of an internal combustion engine. The lubricating oil composition disclosed therein comprises a major amount of an oil having lubricating viscosity and a minor amount of a friction-modifying, polar and surface active organic compound selected from a long list of compounds including mono- and higher esters of polyols and aliphatic amides. Glycerol monooleate and oleamide (i.e. oleylamide) are mentioned as examples of such compounds.

SUMMARY

The present invention is directed in part to a lubricating oil composition having a particular mixture of compounds which in combination provide an improved frictional benefit than either of the compounds alone. This frictional synergy benefit is surprising. Accordingly, disclosed is a lubricating oil composition comprising a major amount of an oil of lubricating viscosity and from 0.25 to 5 weight percent based upon the total mass of the lubricating oil composition of a friction modifier composition containing:

a) an amino alcohol reaction product prepared by isomerizing a $C_{12}$-$C_{30}$ normal alpha olefin using at least one of a solid or liquid catalyst to form an internal olefin; epoxidizing said olefin; and reacting with an mono- or di-hydroxyl hydrocarbyl amine;

b) an ester of glycerol and a $C_{12}$-$C_{22}$ carboxylic acid containing 0 to 3 double bonds.

The normal alpha olefins may be predominantly a single carbon number fraction selected from the group of 1-dodecene, 1-tetradecene, 1-hexadecene, 1-octadecene, 1-eicosene, 1-docosene and 1-tetracosene, where the normal alpha olefin contains greater than 85 weight percent, i.e. greater than 90 weight percent up to and including pure olefin series or they may be mixtures. In one aspect, the normal alpha olefin is a $C_{12}$-$C_{18}$ normal alpha olefin in another; longer chains are employed such as wherein the normal alpha olefin is a $C_{20}$-$C_{30}$ normal alpha olefin.

In one aspect, the mono- or di-hydroxyl hydrocarbyl amine is selected from the formula $HN(R^1OH)_{2-x}H_x$ wherein $R^1$ is a $C_{1-10}$ linear or branched alkylene group and x is 0 or 1. Particularly preferred groups are wherein $R^1$ is a $C_{2-5}$ linear or branched alkylene group. In this respect, the mono- or di-hydroxyl hydrocarbyl amine is preferably selected from the group consisting of ethanolamine, propanolamine, isopropanolamine, butanolamine, sec-butanolamine, diethanolamine, dipropanolamine, di-isopropanolamine, dibutanolamine, and di-sec-butanolamine In a preferred aspect, the ester of glycerol and a $C_{12}$-$C_{22}$ carboxylic acid contains no more than one double bond; and even more preferably the compound b) is a glycerol monooleate. The glycerol monooleate may contain a minor amount of dioleate and a small amount of trioleate but preferably within the mixture the monooleate is in a major amount. The relative amounts of component a) to component b) may vary over the range for the friction modifier, such as 0.25 to 1.5 weight percent (singularly or in combination); and in one aspect the ratio of component a) to component b) is from 0.9:1 to 5:1; more commonly the ratio is 0.9:1 to 1.5:1. In another aspect at least one of component a) or component b) is a borated component. In one aspect only component b) is borated.

In yet another aspect, is directed to a method of lubricating an internal combustion engine, comprising supplying to said engine an oil of lubricating viscosity and from 0.25 to 5 weight percent based upon the total mass of the lubricating oil composition of a friction modifier composition containing:

a) an amino alcohol reaction product prepared by isomerizing a $C_{12}$-$C_{30}$ normal alpha olefin using at least one of a solid or liquid catalyst to form an internal olefin; epoxidizing said olefin; and reacting with an mono- or di-hydroxyl hydrocarbyl amine;

b) an ester of glycerol and a $C_{12}$-$C_{22}$ carboxylic acid containing 0 to 3 double bonds.

DETAILED DESCRIPTION

Typically, glycerol esters of fatty acids, such as oleic acid, are prepared by reacting glycerol and a fatty acid. The product of this reaction is often referred to as, e.g., glyceryl monooleate. However, in a typical commercial product, only about 50-60 mole percent of the esters produced are monoesters. The remainder are primarily diesters, with a small amount of triester. Furthermore, while the product is referred to as glyceryl monooleate (because the starting acid was oleic acid), a typical commercial product contains esters of acids other than oleic acid, because the "oleic acid" used to prepare the ester is, in fact, a mixture of acids of which oleic acid may constitute only about 70 mole percent of the acids. Thus, a typical commercial "glyceryl monooleate" may actually contain only about 38-40 mole percent glyceryl monooleate. Canadian Patent Nos. 1,137,463 and 1,157,846, confirm this usage of the term "glyceryl monooleate" when referring to a mixture of mono-, di, and/or esters.

The monoester or mixture of mono- and diesters is used in an amount effective to reduce fuel consumption in an internal combustion engine. Typically, the lubricating compositions of this invention contain at least 0.15, preferably 0.15 to 2.0 weight percent of the monoester or mixture of mono- and diesters. The esters of this invention may also be borated. Boration passivates hydroxyl groups on the glycerol portion of the esters which helps improve compatibility with rubber seals. If the borated product is desired, it can be prepared by borating the ester with boric acid with removal of the water of reaction. Preferably, there is sufficient boron present such that each boron atom will react with from 1.5 to 2.5 hydroxyl groups present in the reaction mixture. The reaction may be carried out at a temperature in the range of 60° C. to 135° C., in the absence or presence of any suitable organic solvent such as methanol, benzene, xylenes, toluene, neutral oil and the like. A method for borating esters is disclosed in U.S. Pat. No. 4,495,088.

The esters of the present invention are also prepared by reacting glycerol and a $C_{12}$-$C_{22}$ carboxylic acid containing 0 to 3 double bonds in a conventional manner well known in the art. Preferably the carboxylic acid contains one or less double bonds. The preferred acid is oleic acid. As with the commercial products described above, the resulting product is a mixture of mono-, di- and triesters.

Fatty acid esters of glycerol can be prepared by a variety of methods well known in the art. Many of these esters, such as glycerol monooleate and glycerol tallowate, are manufactured on a commercial scale. The esters useful for this invention are oil-soluble and are preferably prepared from $C_{12}$ to $C_{22}$ fatty acids or mixtures thereof such as are found in natural products. The fatty acid may be saturated or unsaturated. Certain compounds found in acids from natural sources may include licanic acid which contains one keto group. Most preferred $C_{16}$ to $C_{18}$ fatty acids are those of the formula R—COOH wherein R is alkyl or alkenyl. Preferred fatty acids are oleic, stearic, isostearic, palmitic, myristic, palmitoleic, linoleic, lauric, linolenic, and eleostearic, and the acids from the natural products tallow, palm oil, olive oil, peanut oil, corn oil, Neat's foot oil and the like. A particularly preferred acid is oleic acid.

The fatty acid monoester of glycerol is preferred, however, mixtures of mono- and diesters may be used. Preferably any mixture of mono- and diester contains at least 40% of the monoester. Typically these mixtures of mono- and diesters of glycerol contain from 40 to 60 percent by weight of the monoester. For example, commercial glycerol monooleate contains a mixture of from 45% to 55% by weight monoester and from 55% to 45% diester. However, higher mono ester can be achieved by distilling the glycerol monoester, diester, triester mixture using conventional distillation techniques, with the monoester portion of the distillate product recovered. This can result in a product which is essentially all monoester. Thus, the esters used in the lubricating oil compositions of this invention may be all monoesters, or a mixture of mono- and diesters in which at least 75 mole percent, preferably at least 90 mole percent, of the mixture is the monoester.

The boric esters of the present invention which meet the above-described requirements can be prepared, for example, as known in the art or by the following methods. (A) Method of reacting carboxylic acid monoglyceride, glycerol, and boric acid at a temperature of 100° to 230° C. (B) Method of reacting glycerol and boric acid and further reacting the resulting compound with carboxylic acid, lower alcohol esters of carboxylic acids, or carboxylic acid halides. (C) Method of reacting mixtures of carboxylic acid triglycerides, glycerol, and boric acid at a temperature of about 240° to 280° C.

In these methods, the respective starting materials be used in amounts satisfying the desired ratios of the boric acid residue, carboxylic acid residue, and glycerol residue in the final product. For instance, it is preferable to use 1 to 2 moles of carboxylic acid monoglycerides and 1 to 0 mole of glycerol per unit mol of boric acid in the method (a), 2 moles of glycerol and 1 to 2 moles of carboxylic acids or their esters or halides per unit mole of boric acid in the method (b), and 1 to 2 moles of carboxylic acid triglycerides and 4 to 5 moles of glycerol per 3 moles of boric acid in the method (c).

Amino Alcohol Reaction Product

The amino alcohol reaction product is prepared by isomerizing a $C_{12}$-$C_{30}$ normal alpha olefin using at least one of a solid or liquid catalyst to form an internal olefin, referred to herein as internalizing; epoxidizing said olefin; and reacting with an alkanol amine. The amino alcohol reaction product is a liquid under ambient conditions and easily blended into the lubricant oil composition. Typically, the lubricating compositions of this invention contain at least 0.1, preferably 0.15 to 4.0 weight percent of the reaction product. Internalizing the alpha olefin followed by transformation to form the corresponding epoxide, and reacting by epoxide ring opening with aminoalkanol results in a liquid product. Terminal olefins tend to produce solids or waxes when employed in a similar reaction scheme.

Normal Alpha Olefins—the olefin for isomerization is a normal alpha olefin selected from olefins having from about 12 to about 30 carbon atoms per molecule, generally originating from ethylene. Examples of the alpha-olefins include 1-dodecene, 1-tetradecene, 1-hexadecene, 1-octadecene, 1-eicosene, 1-docosene, 1-tetracosene, etc. Commercially available alpha-olefin fractions that can be used include the fractions above as relatively pure cuts or mixtures such as, $C_{12-16}$ alpha-olefins, $C_{14-16}$ alpha-olefins, $C_{14-18}$ alpha-olefins, $C_{16-18}$ alpha-olefins, $C_{16-20}$ alpha-olefins, $C_{18-24}$ alpha-olefins, $C_{20-24}$ alpha-olefins, $C_{22-28}$ alpha-olefins, $C_{24-28}$ alpha-olefins, $C_{26-28}$ alpha-olefins, etc. More preferably the normal alpha olefin mixture is selected from olefins having from about 12 to about 28 carbon atoms per molecule. Most preferably, the normal alpha olefin mixture is selected from olefins having from about 12 to about 18 carbon atoms per molecule.

In one aspect of the present invention, the normal alpha olefins (NAO) are isomerized using at least one of a solid or liquid catalyst. The NAO isomerization process can be either a batch, semi-batch, continuous fixed bed or combination of these processes using homogenous or heterogenous catalysts. A solid catalyst preferably has at least one metal oxide and an average pore size of less than 5.5 angstroms. More preferably, the solid catalyst is a molecular sieve with a one-dimensional pore system, such as SM-3, MAPO-11, SAPO-11, SSZ-32, ZSM-23, MAPO-39, SAPO-39, ZSM-22 or SSZ-20. Other possible solid catalysts useful for isomerization include ZSM-35, SUZ-4, NU-23, NU-87 and natural or synthetic ferrierites. These molecular sieves are well known in the art and are discussed in Rosemarie Szostak's Handbook of Molecular Sieves (New York, Van Nostrand Reinhold, 1992) which is herein incorporated by reference for all purposes. A liquid type of isomerization catalyst that can be used is iron pentacarbonyl ($Fe(CO)_5$).

The process for isomerization of normal alpha olefins may be carried out in batch or continuous mode. The process temperatures may range from about 50° C. to about 250° C. In the batch mode, a typical method used is a stirred autoclave or glass flask, which may be heated to the desired reaction temperature. A continuous process is most efficiently carried out in a fixed bed process. Space rates in a fixed bed process can range from 0.1 to 10 or more weight hourly space velocity.

In a fixed bed process, the isomerization catalyst is charged to the reactor and activated or dried at a temperature of at about 150° C. under vacuum or flowing inert, dry gas. After activation, the temperature of the isomerization catalyst is adjusted to the desired reaction temperature and a flow of the olefin is introduced into the reactor. The reactor effluent containing the partially-branched, isomerized olefins is collected. The resulting partially-branched, isomerized olefins contain a different olefin distribution (i.e., alpha olefin, beta olefin; internal olefin, tri-substituted olefin, and vinylidene olefin) and branching content that the unisomerized olefin and conditions are selected in order to obtain the desired olefin distribution and the degree of branching.

The isomerized alpha olefin having an internal (>C═C<) bond is transformed in an epoxidizing step. In some embodiments, the above-described olefin (preferably an internal olefin) can be reacted with a peroxide (e.g., $H_2O_2$) or a peroxy acid (e.g., peroxyacetic acid) more preferably meta-Chloroperoxybenzoic acid (mCPBA) or other peroxycarboxylic acid may used to generate an epoxide. See, e.g., D. Swern, in Organic Peroxides Vol. II, Wiley-Interscience, New York, 1971, pp. 355-533; and B. Plesnicar, in Oxidation in Organic Chemistry, Part C, W. Trahanovsky (ed.), Academic Press, New York 1978, pp. 221-253.

Regarding the step of epoxide ring opening to the corresponding aminoalcohol, this step can run without catalyst or be acid-catalyzed or based-catalyzed. Exemplary catalysts include, but are not limited to, metal perchlorates for example commercially available zinc(II) perchlorate hexahydrate [$Zn(ClO_4)_2.6H_2O$] was found to be a new and highly efficient catalyst for opening of epoxide rings by amines. Other suitable catalysts may be selected from Lewis acids, Lewis bases, Bronsted acids and porphyrin complexes.

Suitable aminoalcohols are selected from amines contain alcoholic hydroxy substituents and alcohols that are useful can contain primary or secondary amino substituents. Typically, the aminoalcohols are primary or secondary alkanol amines or mixtures thereof. Such amines can be represented, respectfully, by the formulae: $H_2N$—R'—OH or HN(R")—R'—OH wherein each R" is independently a hydrocarbyl group of one to about eight carbon atoms or hydroxyl-substituted hydrocarbyl group of two to about eight carbon atoms and R' is a divalent hydrocarbyl group of about two to about 18 carbon atoms. The group —R'—OH in such formulae represents the hydroxyl-substituted hydrocarbyl group. R' can be an acyclic or alicyclic group. Typically, it is an acyclic straight or branched alkylene group such as an ethylene, 1,2-propylene, 1,2-butylene, 1,2-octadecylene, etc. group.

Particularly useful examples of N-(hydroxyl-substituted hydrocarbyl)amines include mono-, di-ethanol amine, diethylethanol amine, di-(3-hydroxyl propyl)amine, N-(3-hydroxyl butyl)amine, N-(4-hydroxyl butyl)amine, N-(2-hydroxyl ethyl)cyclohexyl amine, N-3-hydroxyl cyclopentyl amine, and the like.

Preferred the mono- or di-hydroxyl hydrocarbyl amine are of the formula $HN(R^1OH)_{2-x}H_x$ wherein $R^1$ is a $C_{1-10}$ linear or branched alkylene group and x is 0 or 1 and mixtures thereof. More preferably $R^1$ is a $C_{2-5}$ linear or branched alkylene group. More particularly the mono- or di-hydroxyl hydrocarbyl amine is selected from the group consisting of ethanolamine, propanolamine, isopropanolamine, butanolamine, sec-butanolamine, diethanolamine, dipropanolamine, di-isopropanolamine, dibutanolamine, and di-sec-butanolamine. With ethanolamine and diethanolamine particularly well suited.

The desired reaction product is prepared by isomerizing a $C_{12}$-$C_{30}$ normal alpha olefin using at least one of a solid or liquid catalyst to form an internal olefin; epoxidizing said olefin; and reacting with an N-(hydroxyl-substituted hydrocarbyl)amines; the resulting product may further be borated by contacting this reaction product with a suitable boron source. Thus one aspect is directed to reaction products which are not borated however as above the reaction product may be borated. The boron compound may be any boron containing compound capable of boronating the reaction product. Suitable boron compounds include boron trioxide or any of the various forms of boric acid including metaboric acid ($HBO_2$), orthoboric acid ($H_3BO_3$) and tetraboric acid ($H_2B_4O_2$). Alkyl borates such as the mono-, di- and tri-$C_{1-6}$ alkyl borates may employ. Thus suitable alkyl borates are the mono-, di- and tri-methylborates; the mono-, di- and tri-ethylborates; the mono-, di- and tri-propylborates, and the mono-, di- and tri-butylborates and mixtures thereof. The particularly preferred boron compound is boric acid and especially othoboric acid.

The reaction product can be borated by adding the boron reactant (e.g. boric acid) with the reaction product in a suitable reaction vessel and heating the resulting reaction mixture to boronate the free hydroxyl groups. The reaction temperature is typically conducted at temperatures up to about 250° C., preferably from about 50° C. to about 225° C., and more preferably from out 75° C. to about 150° C. Time for the reaction can be from 2 to 4 hours up to 24 to 48 hours or more, depending upon the temperature, reaction pressure, solvents if used or catalyst if used. Typically the reaction is conducted under atmospheric pressure however the reaction may be conducted under pressure or vacuum. Furthermore, where conditions warrant it a solvent may be used. In general any relatively non-polar, unreactive solvent may be used, such as benzene, toluene, xylene and 1,4-dioxane or mineral oil. Other hydrocarbon and alcohol solvents and mixtures may also be employed.

Typically the boron reaction is conducted until by-product water ceases to evolve from the reaction mixture indicating completion of the reaction. The removal of this water is facilitated by either by use of an inert gas, such as nitrogen contacting the surface of the reaction mixture or by conducting the reaction at reduced pressure. It is preferably that quantities of reactants of boron reactant N-(hydroxyl-substituted hydrocarbyl)amine is based upon nitrogen atoms N:B equivalents form 0.3:1 to 1.5:1 and preferably about 0.5:1. Thus as depicted, boration can be complete or partial. Many borated amine complexes are known in the art see U.S. Pat. Nos. 4,474,671; 4,492,642; 4,622,158 and 4,892,670 and the like.

The desired reaction product prepared by isomerizing a $C_{12}$-$C_{30}$ normal alpha olefin using at least one of a solid or liquid catalyst to form an internal olefin; epoxidizing said olefin; and reacting with an N-(hydroxyl-substituted hydrocarbyl)amines (and borated reaction product) may serve as an additive in that when employed as an additive in lubricating oils, it provides reduced frictional characteristics and also imparts improved wear characteristics. It is also noted that the addition of boration to the reaction product improves corrosivity particularly with respect to copper corrosion and lead corrosion and is expected that such post treatment will improve the seal compatibility of product. When employed in a lubricating oil composition, the lubricating oil composition comprises a major amount of an oil of lubricating viscosity (major amount being greater than 50% by weight of the total composition, preferably more than 60%) and a minor amount of the reaction product prepared by isomerizing a $C_{12}$-$C_{30}$ normal alpha olefin using at least one of a solid or liquid catalyst to form an internal olefin; epoxidizing said olefin; and reacting with an N-(hydroxyl-substituted hydrocarbyl) amines (and borated reaction product). For finished lubricants, typically the amount of N-(hydroxyl-substituted hydrocarbyl)amines (and/or borated reaction product) of the present invention will be from about 0.001 wt % to about 10 wt % based upon the total composition. Preferably it is employed in a amount from 0.05 wt % to about 5 wt % and even more preferably from about 0.1 wt % to 1.5 wt % based upon the total weight of the lubricating oil composition.

The lubricating oil compositions of this invention can be used in the lubrication of essentially any internal composition engine, including automobile and truck engines, two cycle engines, diesel engines, aviation piston engines, marine and railroad engines and the like. Also contemplated are lubricating oils for gas fired engines, alcohol (e.g. methanol) powered engines, stationery powered engines, turbines and the like. Particularly useful are heavy duty diesel engines wherein said lubricating oil compositions of this invention can be employed to improve fuel economy and wherein the borated oil soluble hydroxylated amine salt of a hindered phenolic acid may provide an antioxidant benefit to the lubricating oil composition.

If desired, other additives known in the art may be added to the lubricating oil basestock. Such additives include dispersants, detergents, antiwear agents, extreme pressure agents, antioxidants, rust inhibitors, corrosion inhibitors, pour point depressants, viscosity index improvers, other friction modifiers and the like. Not limiting examples of such are herein below The oil of lubricating viscosity for use in the lubricating oil compositions of this invention, also referred to as a base oil, is typically present in a major amount, e.g., an amount of greater than 50 wt. %, preferably greater than about 70 wt. %, more preferably from about 80 to about 99.5 wt. % and most preferably from about 85 to about 98 wt. %, based on the total weight of the composition. The expression "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both. The base oil for use herein can be any presently known or later-discovered base oil of lubricating viscosity used in formulating lubricating oil compositions for any and all such applications, e.g., engine oils, marine cylinder oils, functional fluids such as hydraulic oils, gear oils, transmission fluids, etc. Additionally, the base oils for use herein can optionally contain viscosity index improvers, e.g., polymeric alkylmethacrylates; olefinic copolymers, e.g., an ethylene-propylene copolymer or a styrene-butadiene copolymer; and the like and mixtures thereof.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C.). Generally, individually the base oils used as engine oils will have a kinematic viscosity range at 100° C. of about 2 cSt to about 30 cSt, preferably about 3 cSt to about 16 cSt, and most preferably about 4 cSt to about 12 cSt and will be selected or blended depending on the desired end use and the additives in the finished oil to give the desired grade of engine oil, e.g., a lubricating oil composition having an SAE Viscosity Grade of 0W, 0W-20, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30 or 15W-40. Oils used as gear oils can have viscosities ranging from about 2 cSt to about 2000 cSt at 100° C.

Base stocks may be manufactured using a variety of different processes including, but not limited to, distillation, solvent refining, hydrogen processing, oligomerization, esterification, and rerefining. Rerefined stock shall be substantially free from materials introduced through manufacturing, contamination, or previous use. The base oil of the lubricating oil compositions of this invention may be any natural or synthetic lubricating base oil. Suitable hydrocarbon synthetic oils include, but are not limited to, oils prepared from the polymerization of ethylene or from the polymerization of 1-olefins to provide polymers such as polyalphaolefin or PAO oils, or from hydrocarbon synthesis procedures using carbon monoxide and hydrogen gases such as in a Fischer-Tropsch process. For example, a suitable base oil is one that comprises little, if any, heavy fraction; e.g., little, if any, lube oil fraction of viscosity 20 cSt or higher at 100° C.

The base oil may be derived from natural lubricating oils, synthetic lubricating oils or mixtures thereof. Suitable base oil includes base stocks obtained by isomerization of synthetic wax and slack wax, as well as hydrocracked base stocks produced by hydrocracking (rather than solvent extracting) the aromatic and polar components of the crude. Suitable base oils include those in all API categories I, II, III, IV and V as defined in API Publication 1509, 14th Edition, Addendum I, December 1998. Group IV base oils are polyalphaolefins (PAO). Group V base oils include all other base oils not included in Group I, II, III, or IV. Although Group II, III and IV base oils are preferred for use in this invention, these base oils may be prepared by combining one or more of Group I, II, III, IV and V base stocks or base oils.

Useful natural oils include mineral lubricating oils such as, for example, liquid petroleum oils, solvent-treated or acid-treated mineral lubricating oils of the paraffinic, naphthenic or mixed paraffinic-naphthenic types, oils derived from coal or shale, animal oils, vegetable oils (e.g., rapeseed oils, castor oils and lard oil), and the like.

Useful synthetic lubricating oils include, but are not limited to, hydrocarbon oils and halo-substituted hydrocarbon oils such as polymerized and interpolymerized olefins, e.g., polybutylenes, polypropylenes, propylene-isobutylene copolymers, chlorinated polybutylenes, poly(1-hexenes), poly(1-octenes), poly(1-decenes), and the like and mixtures thereof; alkylbenzenes such as dodecylbenzenes, tetradecylbenzenes, dinonylbenzenes, di(2-ethylhexyl)-benzenes, and the like; polyphenyls such as biphenyls, terphenyls, alkylated polyphenyls, and the like; alkylated diphenyl ethers and alkylated diphenyl sulfides and the derivative, analogs and homologs thereof and the like.

Other useful synthetic lubricating oils include, but are not limited to, oils made by polymerizing olefins of less than 5 carbon atoms such as ethylene, propylene, butylenes, isobutene, pentene, and mixtures thereof. Methods of preparing such polymer oils are well known to those skilled in the art.

Additional useful synthetic hydrocarbon oils include liquid polymers of alpha olefins having the proper viscosity. Especially useful synthetic hydrocarbon oils are the hydrogenated liquid oligomers of $C_6$ to $C_{12}$ alpha olefins such as, for example, 1-decene trimer.

Another class of useful synthetic lubricating oils includes, but is not limited to, alkylene oxide polymers, i.e., homopolymers, interpolymers, and derivatives thereof where the terminal hydroxyl groups have been modified by, for example, esterification or etherification. These oils are exemplified by the oils prepared through polymerization of ethylene oxide or propylene oxide, the alkyl and phenyl ethers of these polyoxyalkylene polymers (e.g., methyl poly propylene glycol ether having an average molecular weight of 1,000, diphenyl ether of polyethylene glycol having a molecular weight of 500 to 1000, diethyl ether of polypropylene glycol having a molecular weight of 1,000 to 1,500, etc.) or mono- and polycarboxylic esters thereof such as, for example, the acetic esters, mixed $C_3$ to $C_8$ fatty acid esters, or the $C_{13}$ oxo acid diester of tetraethylene glycol.

Yet another class of useful synthetic lubricating oils include, but are not limited to, the esters of dicarboxylic acids e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acids, alkyl malonic acids, alkenyl malonic acids, etc., with a variety of alcohols, e.g., butyl alcohol, hexyl alcohol, dodecyl alcohol, 2-ethylhexyl alcohol, ethylene glycol, diethylene glycol monoether, propylene glycol, etc. Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include, but are not limited to, those made from carboxylic acids having from about 5 to about 12 carbon atoms with alcohols, e.g., methanol, ethanol, etc., polyols and polyol ethers such as neopentyl glycol, trimethylol propane, pentaerythritol, dipentaerythritol, tripentaerythritol, and the like.

Silicon-based oils such as, for example, polyalkyl-, polyaryl-, polyalkoxy- or polyaryloxy-siloxane oils and silicate oils, comprise another useful class of synthetic lubricating oils. Specific examples of these include, but are not limited to, tetraethyl silicate, tetra-isopropyl silicate, tetra-(2-ethylhexyl)silicate, tetra-(4-methyl-hexyl)silicate, tetra-(p-tert-butylphenyl)silicate, hexyl-(4-methyl-2-pentoxy)disiloxane, poly(methyl)siloxanes, poly(methylphenyl)siloxanes, and the like.

The lubricating oil may be derived from unrefined, refined and rerefined oils, either natural, synthetic or mixtures of two or more of any of these of the type disclosed hereinabove. Unrefined oils are those obtained directly from a natural or synthetic source (e.g., coal, shale, or tar sands bitumen) without further purification or treatment. Examples of unrefined oils include, but are not limited to, a shale oil obtained directly from retorting operations, a petroleum oil obtained directly from distillation or an ester oil obtained directly from an esterification process, each of which is then used without further treatment. Refined oils are similar to the unrefined oils except they have been further treated in one or more purification steps to improve one or more properties. These purification techniques are known to those of skill in the art and include, for example, solvent extractions, secondary distillation, acid or base extraction, filtration, percolation, hydrotreating, dewaxing, etc. Rerefined oils are obtained by treating used oils in processes similar to those used to obtain refined oils. Such rerefined oils are also known as reclaimed or reprocessed oils and often are additionally processed by techniques directed to removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst.

Natural waxes are typically the slack waxes recovered by the solvent dewaxing of mineral oils; synthetic waxes are typically the wax produced by the Fischer-Tropsch process.

The ashless dispersant compounds employed in the lubricating oil composition of the present invention are generally used to maintain in suspension insoluble materials resulting from oxidation during use, thus preventing sludge flocculation and precipitation or deposition on metal parts. The lubricating oil composition of the present invention may contain one or more ashless dispersants. Nitrogen-containing ashless (metal-free) dispersants are basic, and contribute to the total base number or TBN (as can be measured by ASTM D2896) of a lubricating oil composition to which they are added, without introducing additional sulfated ash. The term "Total Base Number" or "TBN" as used herein refers to the amount of base equivalent to milligrams of KOH in one gram of sample. Thus, higher TBN numbers reflect more alkaline products, and therefore a greater alkalinity. TBN was determined using ASTM D 2896 test. An ashless dispersant generally comprises an oil soluble polymeric hydrocarbon backbone having functional groups that are capable of associating with particles to be dispersed. Many types of ashless dispersants are known in the art.

Representative examples of ashless dispersants include, but are not limited to, amines, alcohols, amides, or ester polar moieties attached to the polymer backbones via bridging groups. An ashless dispersant of the present invention may be, for example, selected from oil soluble salts, esters, aminoesters, amides, imides, and oxazolines of long chain hydrocarbon substituted mono and dicarboxylic acids or their anhydrides; thiocarboxylate derivatives of long chain hydrocarbons, long chain aliphatic hydrocarbons having a polyamine attached directly thereto; and Mannich condensation products formed by condensing a long chain substituted phenol with formaldehyde and polyalkylene polyamine Carboxylic dispersants are reaction products of carboxylic acylating agents (acids, anhydrides, esters, etc.) comprising at least about 34 and preferably at least about 54 carbon atoms with nitrogen containing compounds (such as amines), organic hydroxy compounds (such as aliphatic compounds including monohydric and polyhydric alcohols, or aromatic compounds including phenols and naphthols), and/or basic inorganic materials. These reaction products include imides, amides, and esters.

Succinimide dispersants are a type of carboxylic dispersants. They are produced by reacting hydrocarbyl-substituted succinic acylating agent with organic hydroxy compounds, or with amines comprising at least one hydrogen atom attached to a nitrogen atom, or with a mixture of the hydroxy compounds and amines. The term "succinic acylating agent" refers to a hydrocarbon-substituted succinic acid or a succinic acid-producing compound, the latter encompasses the acid itself. Such materials typically include hydrocarbyl-substituted succinic acids, anhydrides, esters (including half esters) and halides.

Succinic-based dispersants have a wide variety of chemical structures. One class of succinic-based dispersants is bissuccinimides having a hydrocarbyl group attached to the maleic moiety wherein each group is independently a hydrocarbyl group, such as a polyolefin-derived group. Typically the hydrocarbyl group is an alkyl group, such as a polyisobutyl group. Alternatively expressed, the hydrocarbyl groups can contain about 40 to about 500 carbon atoms, and these atoms may be present in aliphatic forms. The polyamines are alkylene polyamines wherein the alkylene group, commonly an ethylene ($C_2H_4$) group.

Examples of succinimide dispersants include those described in, for example, U.S. Pat. Nos. 3,172,892, 4,234,435 and 6,165,235.

The polyalkenes from which the substituent groups are derived are typically homopolymers and interpolymers of polymerizable olefin monomers of 2 to about 16 carbon atoms, and usually 2 to 6 carbon atoms. The amines which are reacted with the succinic acylating agents to form the carboxylic dispersant composition can be monoamines or polyamines Certain fundamental types of succinimides and the related materials encompassed by the term of art "succinimide" are taught in U.S. Pat. Nos. 3,172,892; 3,219,666 and 3,272,746, the content of which is incorporated by reference herein. The term "succinimide" is understood in the art to include many of the amide, imide, and amidine species which may also be formed. The predominant product however is a succinimide and this term has been generally accepted as meaning the product of a reaction of an alkenyl substituted succinic acid or anhydride with a nitrogen-containing compound. Preferred succinimides, because of their commercial availability, are those succinimides prepared from a hydrocarbyl succinic anhydride, wherein the hydrocarbyl group contains from about 24 to about 350 carbon atoms, and an ethylene amine Examples of ethylene amines include ethylene diamine, diethylene triamine, triethylene tetramine, tetraethylene pentamine and the like. Particularly preferred are those succinimides prepared from polyisobutenyl succinic anhydride of about 70 to about 128 carbon atoms and tetraethylene pentamine or triethylene tetramine and mixtures thereof.

Succinimide dispersants are referred to as such since they normally contain nitrogen largely in the form of imide functionality, although the amide functionality may be in the form of amine salts, amides, imidazolines as well as mixtures thereof. To prepare a succinimide dispersant, one or more succinic acid-producing compounds and one or more amines are heated and typically water is removed, optionally in the presence of a substantially inert organic liquid solvent/diluent. The reaction temperature can range from about 80° C. up to the decomposition temperature of the mixture or the product, which typically falls between about 100° C. to about 300° C. Additional details and examples of procedures for preparing the succinimide dispersants of the present invention include those described in, for example, U.S. Pat. Nos. 3,172,892, 3,219,666, 3,272,746, 4,234,435, 6,165,235 and 6,440,905.

Suitable ashless dispersants may also include amine dispersants, which are reaction products of relatively high molecular weight aliphatic halides and amines, preferably polyalkylene polyamines Examples of such amine dispersants include those described in, for example, U.S. Pat. Nos. 3,275,554, 3,438,757, 3,454,555 and 3,565,804.

Suitable ashless dispersants may further include "Mannich dispersants," which are reaction products of alkyl phenols in which the alkyl group contains at least about 30 carbon atoms with aldehydes (especially formaldehyde) and amines (especially polyalkylene polyamines). Examples of such dispersants include those described in, for example, U.S. Pat. Nos. 3,036,003, 3,586,629. 3,591,598 and 3,980.569.

Suitable ashless dispersants may also be post-treated ashless dispersants such as post-treated succinimides, e.g., post-treatment processes involving borate or ethylene carbonate as disclosed in, for example, U.S. Pat. Nos. 4,612,132 and 4,746,446; and the like as well as other post-treatment processes. The carbonate-treated alkenyl succinimide is a polybutene succinimide derived from polybutenes having a molecular weight of about 450 to about 3000, preferably from about 900 to about 2500, more preferably from about 1300 to about 2300, and most preferably from about 2000 to about 2400, as well as mixtures of these molecular weights. Preferably, it is prepared by reacting, under reactive conditions, a mixture of a polybutene succinic acid derivative, an unsaturated acidic reagent copolymer of an unsaturated acidic reagent and an olefin, and a polyamine, such as disclosed in U.S. Pat. No. 5,716,912, the contents of which are incorporated herein by reference.

Suitable ashless dispersants may also be polymeric, which are interpolymers of oil-solubilizing monomers such as decyl methacrylate, vinyl decyl ether and high molecular weight olefins with monomers containing polar substitutes. Examples of polymeric dispersants include those described in, for example, U.S. Pat. Nos. 3,329,658; 3,449,250 and 3,666,730.

In a preferred embodiment of the present invention, an ashless dispersant for use in the lubricating oil composition is an ethylene, carbonate-treated bissuccinimide derived from a polyisobutenyl group having a number average molecular weight of about 2300. The dispersant(s) for use in the lubricating oil compositions of the present invention are preferably non-polymeric (e.g., are mono- or bissuccinimides).

Generally, the ashless dispersant is present in the lubricating oil composition in an amount ranging from about 3 to about 10 wt. %, and preferably from about 4 to about 8 wt. %, based on the total weight of the lubricating oil composition.

The at least one metal-containing detergent compound employed in the lubricating oil composition of the present invention functions both as a detergent to reduce or remove deposits and as an acid neutralizer or rust inhibitor, thereby reducing wear and corrosion and extending engine life. Detergents generally comprise a polar head with long hydrophobic tail, with the polar head comprising a metal salt of an acid organic compound.

The lubricating oil composition of the present invention may contain one or more detergents, which are normally salts, and especially overbased salts. Overbased salts, or overbased materials, are single phase, homogeneous Newtonian systems characterized by a metal content in excess of that which would be present according to the stoichiometry of the metal and the particular acidic organic compound reacted with the metal. The overbased materials are prepared by reacting an acidic material (typically an inorganic acid or lower carboxylic acid such as carbon dioxide) with a mixture comprising an acidic organic compound, in a reaction medium comprising at least one inert, organic solvent (such as mineral oil, naphtha, toluene, xylene) in the presence of a stoichiometric excess of a metal base and a promoter.

Useful acidic organic compounds for making the overbased compositions include carboxylic acids, sulfonic acids, phosphorus-containing acids, phenols and mixtures thereof. Preferably, the acidic organic compounds are carboxylic acids or sulfonic acids with sulfonic or thiousulfonic groups (such as hydrocarbyl-substituted benzenesulfonic acids), and hydrocarbyl-substituted salicylic acids.

Carboxylate detergents, e.g., salicylates, can be prepared by reacting an aromatic carboxylic acid with an appropriate metal compound such as an oxide or hydroxide. Neutral or overbased products may then be obtained by methods well known in the art. The aromatic moiety of the aromatic carboxylic acid can contain one or more heteroatoms such as nitrogen and oxygen. Preferably, the moiety contains only carbon atoms. More preferably, the moiety contains six or more carbon atoms, such as a benzene moiety. The aromatic carboxylic acid may contain one or more aromatic moieties, such as one or more benzene rings, optionally fused together or otherwise connected via alkylene bridges. Representative examples of aromatic carboxylic acids include salicylic acids and sulfurized derivatives thereof such as hydrocarbyl substituted salicylic acid and derivatives thereof. Processes for sulfurizing, for example, a hydrocarbyl-substituted salicylic acid, are known to those skilled in the art. Salicylic acids are typically prepared by carboxylation, for example, by the Kolbe-Schmitt process, of phenoxides. In that case, salicylic acids are generally obtained in a diluent in admixture with an uncarboxylated phenol.

Metal salts of phenols and sulfurized phenols are prepared by reaction with an appropriate metal compound such as an oxide or hydroxide. Neutral or overbased products may be obtained by methods well known in the art. For example, sulfurized phenols may be prepared by reacting a phenol with sulfur or a sulfur-containing compound such as hydrogen sulfide, sulfur monohalide or sulfur dihalide, to form products that are mixtures of compounds in which 2 or more phenols are bridged by sulfur-containing bridges.

The metal compounds useful in making the overbased salts are generally any Group I or Group II metal compounds in the Periodic Table of the Elements. Group I metals of the metal base include Group Ia alkali metals (e.g., sodium, potassium, lithium) as well as Group Ib metals such as copper. Group I metals are preferably sodium, potassium, lithium and copper, more preferably sodium or potassium, and particularly preferably sodium. Group II metals of the metal base include Group IIa alkaline earth metals (e.g., magnesium, calcium, strontium, barium) as well as Group IIb metals such as zinc or cadmium. Preferably, the Group II metals are magnesium, calcium, barium, or zinc, more preferably magnesium or calcium, and most preferably calcium.

Examples of the overbased detergents include, but are not limited to, calcium sulfonates, calcium phenates, calcium salicylates, calcium stearates and mixtures thereof. Overbased detergents suitable for use in the lubricating oil compositions of the present invention may be low overbased (e.g., an overbased detergent having a TBN below about 100). The TBN of such a low-overbased detergent may be from about 5 to about 50, or from about 10 to about 30, or from about 15 to about 20. Alternatively, the overbased detergents suitable for use in the lubricating oil compositions of the present invention may be high overbased (e.g., an overbased detergent having a TBN above about 100). The TBN of such a high-overbased detergent may be from about 150 to about 450, or from about 200 to about 350, or from about 250 to about 280. A low-overbased calcium sulfonate detergent with a TBN of about 17 and a high-overbased sulfurized calcium phenate with a TBN of about 400 are two exemplary overbased detergents for use in the lubricating oil compositions of the present invention. The lubricating oil compositions of the present invention may contain more than one overbased detergent, which may be all low-TBN detergents, all high-TBN detergents, or a mixture thereof. For example, the lubricating oil compositions of the present invention may contain a first metal-containing detergent which is an overbased alkaline earth metal sulfonate detergent having a TBN of about 150 to about 450 and a second metal-containing detergent which is an overbased alkaline earth metal sulfonate detergent having a TBN of about 10 to about 50.

Suitable detergents for the lubricating oil compositions of the present invention also include "hybrid" detergents such as, for example, phenate/salicylates, sulfonate/phenates, sulfonate/salicylates, sulfonates/phenates/salicylates, and the like. Examples of hybrid detergents include those described in, for example, U.S. Pat. Nos. 6,153,565; 6,281,179; 6,429,178, and 6,429,179.

Generally, the metal-containing detergent is present in the lubricating oil composition in an amount ranging from about 0.25 to about 3 wt. %, and preferably from about 0.5 to about 2 wt. %, based on the total weight of the lubricating oil composition.

The antioxidant compounds employed in the lubricating oil composition of the present invention reduce the tendency of base stocks to deteriorate in service, which deterioration can be evidenced by the products of oxidation such as sludge and varnish-like deposits on the metal surfaces and by viscosity growth. Such oxidation inhibitors include hindered phenols, ashless oil soluble phenates and sulfurized phenates, alkyl-substituted diphenylamine, alkyl-substituted phenyl and naphthylamines and the like and mixtures thereof. Suitable diphenylamine antioxidants include, but are not limited to, monoalkylated diphenylamine, dialkylated diphenylamine, trialkylated diphenylamine, and the like and mixtures thereof. Representative examples of diphenylamine antioxidants include butyldiphenylamine, di-butyldiphenylamine, octyldiphenylamine, di-octyldiphenylamine, nonyldiphenylamine, di-nonyldiphenylamine, t-butyl-t-octyldiphenylamine, and the like and mixtures thereof.

Generally, the antioxidant compound is present in the lubricating oil composition in an amount ranging from about 0.2 to about 4 wt. %, and preferably from about 0.3 to about 1 wt. %, based on the total weight of the lubricating oil composition.

The anti-wear agent compounds employed in the lubricating oil composition of the present invention include molybdenum-containing complexes such as, for example, a molybdenum/nitrogen-containing complex. Such complexes are known in the art and are described, for example, in U.S. Pat. No. 4,263,152, the content of which is incorporated by reference herein.

Generally, the molybdenum/nitrogen-containing complex can be made with an organic solvent comprising a polar promoter during a complexation step and procedures for preparing such complexes are described, for example, e.g., in U.S. Pat. Nos. 4,259,194; 4,259,195; 4,261,843; 4,263,152; 4,265,773; 4,283,295; 4,285,822; 4,369,119; 4,370,246; 4,394,279; 4,402,840; and 6,962,896 and U.S. Patent Application Publication No. 2005/0209111, the contents of which are incorporated by reference herein. As shown in these references, the molybdenum/nitrogen-containing complex can further be sulfurized.

Generally, the anti-wear agent compounds are present in the lubricating oil composition in an amount ranging from about 0.25 to about 5 wt. %, and preferably from about 0.3 to about 2 wt. %, based on the total weight of the lubricating oil composition.

Preferably a minor amount of antiwear agent, a metal dihydrocarbyl dithiophosphate is added to the lubricant composition. The metal is preferably zinc. The dihydrocarbyldithiophosphate may be present in amount of 0.1 to 2.0 mass percent but typically low phosphorous compositions are desired so the dihydrocarbyldithiophosphate is employed at 0.25 to 1.2, preferably 0.5 to 0.7, mass %, in the lubricating oil composition. Preferably, zinc dialkylthiophosphate (ZDDP) is used. This provides antioxidant and antiwear properties to the lubricating composition. Such compounds may be prepared in accordance with known techniques by first forming a dithiophosphoric acid, usually by reaction of an alcohol or a phenol with $P_2S_5$ and then neutralizing the dithiophosphoric acid with a suitable zinc compound. Mixtures of alcohols may be used including mixtures of primary and secondary alcohols. Examples of such alcohols include, but are not restricted to the following list: iso-propanol, iso-octanol, 2-butanol, methyl isobutyl carbinol (4-methyl-1-pentane-2-ol), 1-pentanol, 2-methyl butanol, and 2-methyl-1-propanol. The hydrocarbyl groups can be a primary, secondary, or mixtures thereof, e.g. the compounds may contains primary and/or secondary alkyl groups derived from primary or secondary carbon atoms. Moreover, when employed, there is preferably at least 50, more preferably 75 or more, most preferably 85 to 100, mass % secondary alkyl groups; an example is a ZDDP having 85 mass % secondary alkyl groups and 15 mass % primary alkyl groups, such as a ZDDP made from 85 mass % butan-2-ol and 15 mass % iso-octanol. Even more preferred is a ZDDP derived from derived from sec-butanol and methylisobutylcarbinol and most preferably wherein the sec-butanol is 75 mole percent.

The metal dihydrocarbyldithiophosphate provides most if not all, of the phosphorus content of the lubricating oil composition. Amounts are present in the lubricating oil composition to provide a phosphorus content, expressed as mass % elemental phosphorus, of 0.10 or less, preferably 0.08 or less, and more preferably 0.075 or less, such as in the range of 0.025 to 0.07.

The lubricating oil compositions of the present invention can be conveniently prepared by simply blending or mixing the lubricating oil and the friction modifier blend of (0.25 to 5 weight percent based upon the total mass of the lubricating oil composition of a friction modifier composition containing a) an amino alcohol reaction product prepared by isomerizing a $C_{12}$-$C_{30}$ normal alpha olefin using at least one of a solid or liquid catalyst to form an internal olefin; epoxidizing said olefin; and reacting with an mono- or di-hydroxyl hydrocarbyl amine; b) an ester of glycerol and a $C_{12}$-$C_{22}$ carboxylic acid containing 0 to 3 double bonds, optionally other additives may be blended such as the ashless dispersant, at least one metal-containing detergent, antioxidant and anti-wear agent, optionally with other additives, with the oil of lubricating viscosity. The friction modifier blend (above), ashless dispersant, metal-containing detergent, antioxidant and anti-wear agent may also be preblended as a concentrate or package with various other additives, if desired, in the appropriate ratios to facilitate blending of a lubricating composition containing the desired concentration of additives. The friction modifier blend, ashless dispersant, at least one metal-containing detergent, antioxidant and anti-wear agent are blended with the base oil using a concentration at which they provide improved friction effect and are both soluble in the oil and compatible with other additives in the desired finished lubricating oil. Compatibility in this instance generally means that the present compounds as well as being oil soluble in the applicable treat rate also do not cause other additives to precipitate under normal conditions. Suitable oil solubility/compatibility ranges for a given compound of lubricating oil formulation can be determined by those having ordinary skill in the art using routine solubility testing procedures. For example, precipitation from a formulated lubricating oil composition at ambient conditions (about 20° C. to 25° C.) can be measured by either actual precipitation from the oil composition or the formulation of a "cloudy" solution which evidences formation of insoluble wax particles.

The lubricating oil compositions of the present invention may also contain other conventional additives for imparting auxiliary functions to give a finished lubricating oil composition in which these additives are dispersed or dissolved. For example, the lubricating oil compositions can be blended with friction modifiers, rust inhibitors, dehazing agents, demulsifying agents, metal deactivating agents, pour point depressants, antifoaming agents, co-solvents, package compatibilisers, corrosion-inhibitors, dyes, extreme pressure agents and the like and mixtures thereof. A variety of the additives are known and commercially available. These additives, or their analogous compounds, can be employed for the preparation of the lubricating oil compositions of the invention by the usual blending procedures.

Examples of supplemental friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a $C_4$ to $C_{75}$, preferably a $C_6$ to $C_{24}$, and most preferably a $C_6$ to $C_{20}$, fatty acid ester and a nitrogen-containing compound selected from the group consisting of ammonia, and an alkanolamine and the like and mixtures thereof. The friction modifier can be incorporated in the lubricating oil composition in an amount ranging of from about 0.02 to about 2.0 wt. % of the lubricating oil composition, preferably from about 0.05 to about 1.0 wt. %, and more preferably from about 0.1 to about 0.5 wt. %.

Examples of rust inhibitors include, but are not limited to, nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof.

Examples of antifoaming agents include, but are not limited to, polymers of alkyl methacrylate; polymers of dimethylsilicone and the like and mixtures thereof.

The lubricating composition of the present invention may also contain a viscosity index improver. Examples of the viscosity index improvers include poly-(alkyl methacrylate), ethylene-propylene copolymer, styrene-butadiene copolymer, and polyisoprene. Viscosity index improvers of the dispersant type (having increased dispersancy) or multifunction type are also employed. These viscosity index improvers can be used singly or in combination. The amount of viscosity index improver to be incorporated into an engine oil varies with desired viscosity of the compounded engine oil, and generally in the range of about 0.5 to about 20 wt. % per total amount of the engine oil.

EXAMPLES

The invention is further illustrated by the following examples, which are not to be considered as limitative of its scope. A further understanding of the invention can be had in the following non-limiting Preparations and Examples.

Synthetic Examples and Preparations:

All temperatures in the examples attached refer to the Centigrade system and the term "room temperature" refers to about 20-25° C. The term "percent or %" refers to weight percent, and the term "mole" or "moles" refers to gram moles. The term "equivalent" refers to a quantity of reagent equal in moles, to the moles of the preceding of succeeding reactant recited in that example in terms of finite moles or finite weight or volume. Proton-magnetic resonance spectra (NMR) were determined at 300 mHz.

A. Isomerization of Olefin Step

Preparation Example 1

C12 Alpha Olefin Isomerization

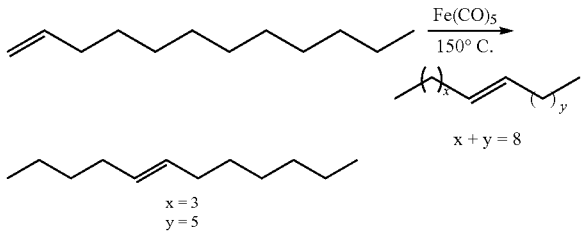

Alpha olefin (here using C12 as an example) is isomerized with iron pentacarbonyl, the double bond of the starting material (C12 alpha olefin), as a result of isomerization, is now distributed internally all along the carbon chain.

180 grams of C12 alpha olefin was dried over 50 grams of Molecular sieves (25 gram 3A and 25 gram 4A) under nitrogen overnight, then was transferred in a 1 L reaction flask. 0.8 mL of Fe $(CO)_5$ was injected into the flask. The reaction mixture was then heated in an oil bath at 175° C. for 4 hours under nitrogen. IR demonstrated the reaction had finished. The oil bath temperature was lowered to 85° C. 7.5 grams of silica gel and 10 drops of Methanesulfonic acid were added and the mixture was stirred overnight. The brownish oil in the flask was filtered over a silica pad and a colorless liquid was obtained as compound 1. NMR ($CDCl_3$) δ 5.4 (m, 2H); 2.0 (m, 4H); 1.35 (m, 12H); 0.9 (m, 6H). IR 2957.2, 2923.4, 2854.3, 1457.4.2, 1377.9, 964.7, 723.8 $cM^{-1}$

Preparation Example 2

C20-24 Alpha Olefin Isomerization

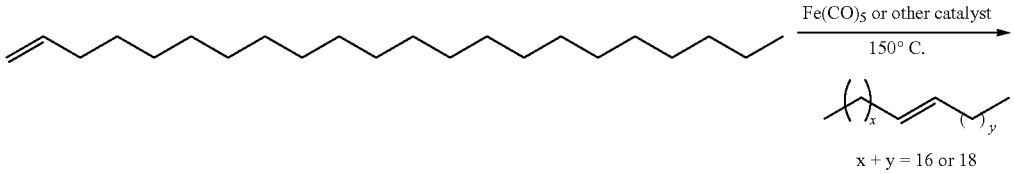

130 grams of C20-24 alpha olefin was dried over 30 grams of molecular sieves (15 gram 3A and 15 gram 4A) under nitrogen overnight, then was transferred in a 1 L reaction flask. 0.3 mL of Fe $(CO)_5$ was injected into the flask. The reaction mixture was then heated in an oil bath at 153° C. for overnight. IR demonstrated the reaction has finished. The oil bath temperature was lowered to 85° C. 5 grams of silica gel and 10 drops of Methanesulfonic acid were added and the mixture was stirred overnight. The brownish oil in the flask was filtered over a silica pad and a colorless liquid was obtained as compound 2.

B. Epoxidation Step

Preparation Example 3

Epoxidation (with C12 Internal Olefin as Example)

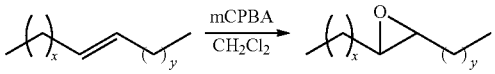

x + y = 8 x + y = 8

92 grams of isomerized olefin was dissolved in 500 mL methylene chloride in a 1 L flask, the reaction mixture's temperature was cooled to 0° C. with an ice/water bath, and then 112 grams of mCPBA (77%) was added slowly in small portions to the reaction mixture. The reaction mixture was then stirred for 22 hours under nitrogen. Then the reaction mixture was diluted in hexane filtered with a silica pad, rotovaped to dryness to give a colorless liquid as the desired epoxide, compound 3. NMR ($CDCl_3$) δ 2.6-3.05, (m, 2H); 1.1-1.7, (m, 16H); 0.9-1, (m, 6H).

Preparation Example 4

Epoxidation (with C20-24 Internal Olefin as Example)

122 grams of isomerized C20-24 olefin was dissolved in 500 mL methylene chloride in a 1 L flask in an ice/water bath at 0° C., and then 106 grams of mCPBA (77%) was added slowly in small portions to the reaction mixture to avoid overheating. The reaction mixture was stirred for 24 hours under nitrogen. Then the reaction mixture was diluted in hexane and filtered with a silica pad, washed with sodium bicarbonate and dried with sodium sulfate, the resulting product was then rotovaped to dryness to give a colorless liquid as the desired epoxide, compound 4. NMR ($CDCl_3$) δ 2.6-2.9, (m, 2H); 1.1-1.7, (m, 32-40H); 0.9-1, (m, 6H).

C. Epoxide Reacts with Aliphatic Amines.

Preparation Example 5

Epoxide Opening with Ethanol Amine (with C12 Internal Epoxide as Example)

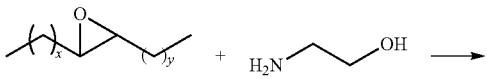

x + y = 8

-continued

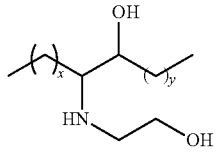

x + y = 8

To a flask with internal compound 3 C12 epoxide (60 grams, 326 mmol) was added ethanol amine (20 grams, 327 mmol) and 2.42 gram of $Zn(ClO_4)_2.6H_2O$. The mixture was heated at 125° C. in oil bath for overnight and light brown liquid was obtained, the liquid was diluted with ethyl acetate and then water washed twice, dried with sodium sulfate and rotovaped to dryness under reduced pressure to give compound 5. NMR ($CDCl_3$) δ 3.8 (m, 3H), 2.8-3, (m, 3H), 1.4-1.6 (m, 16H), 1-1.1 (m, 6H).

Preparation Example 6

Epoxide Opening with Diethanol Amine (with C14 Internal Epoxide as Example)

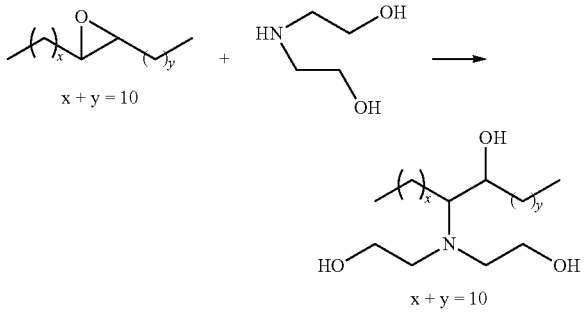

x + y = 10 x + y = 10

Five grams of C14 internal epoxide prepared according to preparative Example 1 and 3 (23.58 mmol) and 4.9 gram of diethanol amine (47.16 mmol) were charged to a flask. To the mixture was added 0.2 gram of $Zn(ClO_4)_2.6H_2O$. The mixture was heated at 140° C. for overnight. Then the reaction mixture was diluted in ethyl acetate, washed with water and brine, dried with sodium sulfate and rotovaped to dryness. The product compound 6 was obtained as an amber liquid ready for testing.

Preparation Example 7

Epoxide Opening with Ethanol Amine (with C20-24 Internal Epoxide as Example)

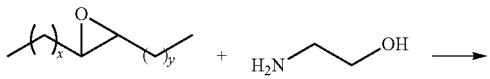

x + y = 16

-continued

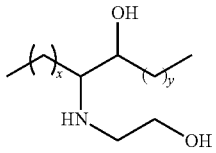

x + y = 16

To a flask with (15 grams, 46.2 mmols) of C20-24 internal epoxide was added ethanol amine (2.82 grams, 46.2 mmol) and $Zn(ClO_4)_2.6H_2O$ (0.34 grams, 0.9 mmol). The mixture was heated at 170° C. in oil bath for 48 hours and light brown liquid was obtained. The reaction mixture was diluted with ethyl acetate and then water washed twice, dried with sodium sulfate and rotovaped to dryness under reduced pressure to give product NMR ($CDCl_3$) δ 3.7 (m, 3H), 2.7-2.8, (m, 3H), 1.4-1.6 (m, 32H), 1-1.1 (m, 6H). Final Product's TBN is 213.8.

Evaluation of Friction Performance

Example A

Baseline A

A 5W-30 oils (SAE viscosity grade) baseline lubricating oil composition was prepared using the following additives: a polyalkylsuccinimide dispersant, approximately 4 wt % of a 2300 avg molecular weight polyisobutylene succinic anhydride with a heavy polyamine post treated with ethylene carbonate, approximately 0.6 wt % of a low overbased (17 TBN) calcium alkylaryl sulfonate, about 1 wt % of a high overbased (410 TBN) calcium alkyltoluene sulfonate, zinc dialkyldithiophosphate derived from a mixture of primary and secondary alcohols to provide about 0.07 wt % phosphorous to the finished lubricating oil, 1.2 wt. % of a diphenylamine (octylated/butylated) antioxidant, 0.5 wt % of a molybdenum/nitrogen containing complex, and a viscosity index improver, a pour point depressant and a foam inhibitor to a majority of a Group II baseoil.

Example B (Comparative)

A lubricating oil composition was prepared by top-treating the baseline formulation of Performance Example A with 0.5 wt. % of a borated glycerol monooleate as disclosed in U.S. Pat. No. 5,629,272. Example C (Comparative) was prepared by top-treating the baseline formulation of Performance Example A with 1.0 wt % of the borated glycerol monoloate.

Additional lubricating oil compositions were also prepared by top-treating the baseline formulation of Performance Example A with various amount of the glycerol monooleate with various amount of compound 5 of Preparation Example 5 at various amount (shown in Table 1 below) as Examples 1-2 as well as various amounts of compound 6 of Preparative Example 6 as Examples 3-4. The lubricating oil compositions presented in the examples were 5W-30 oils (SAE viscosity grade).

The compositions described above were tested for friction performance in a Mini-Traction Machine (MTM) bench test. The MTM is manufactured by PCS Instruments and operates with a ball (0.75 inches 8620 steel ball) loaded against a rotating disk (52100 steel). The conditions employ a load of approximately 10-30 Newtons, a speed of approximately 10-2000 mm/s and a temperature of approximately 125-150° C. In this bench test, friction performance is measured as the comparison of the total area under the second Stribeck curve generated with the baseline formulation and the second Stribeck curve generated with the baseline formulation top-treated with a friction modifier. Lower total area values correspond to better friction performance of the oil.

TABLE 1

| Frictional properties | | | |
|---|---|---|---|
| Performance Example | Friction Amimoalcohol derived from isomerized alpha olefin | Modifier Borated glycerol monooleate | Stribeck Area |
| Example A | None | None | 131 |
| Example B | 0 | 0.5 | 95.2 |
| Example C | 0 | 1.0 | 76.5 |
| Example D* | 0.5 | 0 | 77.5 |
| Example E* | 1.0 | 0 | 57.3 |
| Example 1* | 0.25 | 0.25 | 65.1 |
| Example 2* | 0.5 | 0.5 | 50.7 |
| Example F** | 0.5 | 0 | 52.3 |
| Example G** | 1.0 | 0 | 59.3 |
| Example 3** | 0.25 | 0.25 | 88.9 |
| Example 4** | 0.5 | 0.5 | 49.7 |

*Preparative Example 5
**Preparative Example 6

The results demonstrate that lubricating oil compositions of the present invention demonstrate superior friction performance to lubricating oil compositions over base line as well as those containing a commonly employed borated glycerol monooleate friction. The synergy in the frictional data reaction product prepared by isomerizing a $C_{12}$-$C_{30}$ normal alpha olefin using at least one of a solid or liquid catalyst to form an internal olefin; epoxidizing said olefin; and reacting with an N-(hydroxyl-substituted hydrocarbyl)amines (and borated reaction product) modifier. The combination demonstrates a synergy among the either of the components performance individually.

What is claimed is:

1. A method of lubricating an internal combustion engine, comprising supplying to said engine an oil of lubricating viscosity and from 0.25 to 5 weight percent based upon the total mass of the lubricating oil composition of a friction modifier composition containing:

a) an amino alcohol reaction product prepared by isomerizing a $C_{12}$-$C_{30}$ normal alpha olefin using at least one of a solid or liquid catalyst to form an internal olefin; epoxidizing said olefin; and reacting with a mono-hydroxyl hydrocarbyl amine;

b) an ester of glycerol and a $C_{12}$-$C_{22}$ carboxylic acid containing 0 to 3 double bonds.

2. The method of claim 1, wherein the normal alpha olefin is a $C_{12}$-$C_{18}$ normal alpha olefin.

3. The method according to claim 1 wherein b) is a glycerol monooleate.

4. The method according to claim 3 wherein b) is a glycerol monooleate is borated.

5. A lubricating oil composition comprising a major amount of an oil of lubricating viscosity and from 0.25 to 5 weight percent based upon the total mass of the lubricating oil composition of a friction modifier composition containing:

a) an amino alcohol reaction product prepared by isomerizing a $C_{12}$-$C_{30}$ normal alpha olefin using at least one of a solid or liquid catalyst to form an internal olefin; epoxidizing said olefin; and reacting with a mono-hydroxyl hydrocarbyl amine; and b) an ester of glycerol and a $C_{12}$-$C_{22}$ carboxylic acid containing 0 to 3 double bonds.

6. The lubricating oil composition according to claim 5, wherein the normal alpha olefin is a $C_{12}$-$C_{18}$ normal alpha olefin.

7. The lubricating oil composition according to claim 5, wherein the normal alpha olefin is a $C_{20}$-$C_{30}$ normal alpha olefin.

8. The lubricating oil composition according to claim 5, wherein the normal alpha olefin contains greater than 85 weight percent of a single carbon number fraction selected from the group of 1-dodecene, 1-tetradecene, 1-hexadecene, 1-octadecene, 1-eicosene, 1-docosene and 1-tetracosene.

9. The lubricating oil composition according to claim 5, wherein the mono-hydroxyl hydrocarbyl amine is of the formula $HN(R^1OH)_{2-x}H_x$ wherein $R^1$ is a $C_{1-10}$ linear or branched alkylene group and x is 1.

10. The lubricating oil composition according to claim 9, wherein $R^1$ is a $C_{2-5}$ linear or branched alkylene group.

11. The lubricating oil composition according to claim 5, wherein the mono-hydroxyl hydrocarbyl amine is selected from the group consisting of ethanolamine, propanolamine, isopropanolamine, butanolamine, and sec-butanolamine.

12. The lubricating oil composition according to claim 5 wherein b) is a glycerol monooleate.

13. The lubricating oil composition according to claim 5 wherein the ratio of component a) to component b) is from 0.9:1 to 5:1.

* * * * *